US005951167A

United States Patent [19]

Tate

[11] Patent Number: 5,951,167

[45] Date of Patent: Sep. 14, 1999

[54] BROOMSTICK SKIRT DRYING TUBE

[76] Inventor: Sherlene Tate, Rte. #1 Box 298A, Trout, La. 71371

[21] Appl. No.: 09/036,427

[22] Filed: Mar. 5, 1998

[51] Int. Cl.[6] ..... B65D 33/14

[52] U.S. Cl. ..... 383/24; 383/41; 383/43; 383/117; 150/154

[58] Field of Search ..... 383/24, 41, 43, 383/67, 117, 118, 907; 150/154

[56] References Cited

U.S. PATENT DOCUMENTS

| | | | |
|---|---|---|---|
| 663,253 | 12/1900 | Bowman | 383/67 X |
| 1,689,399 | 10/1928 | Malone | 383/67 X |
| 1,749,776 | 3/1930 | O'Lena | 383/117 X |
| 2,035,384 | 3/1936 | Hinchliff | 383/118 X |
| 2,530,250 | 11/1950 | Leith | 383/41 X |
| 4,047,550 | 9/1977 | Scholz | 383/117 X |
| 4,548,375 | 10/1985 | Moss | 383/24 X |
| 5,451,108 | 9/1995 | Anderson | 383/67 X |

*Primary Examiner*—Jes F. Pascua

[57] ABSTRACT

A new broomstick skirt drying tube for creating sharp creases in broomstick skirts. The inventive device includes a tube constructed of a flexible open weave material. The tube has an open upper end and an open lower end. The open lower end has a greater diameter than the open upper end. The open upper end has a cylindrical collar extending downwardly thereof. The tube is dimensioned for receiving a wet skirt therein.

4 Claims, 2 Drawing Sheets

BROOMSTICK SKIRT DRYING TUBE

BACKGROUND OF THE INVENTION

1. Field of the Invention

The present invention relates to garment bags and more particularly pertains to a new broomstick skirt drying tube for creating sharp creases in broomstick skirts.

2. Description of the Prior Art

The use of garment bags is known in the prior art. More specifically, garment bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art garment bags include U.S. Pat. No. 4,795,268 to Jorda; U.S. Pat. No. 5,050,999 to Van Loon, III; U.S. Pat. No. 5,320,429 to Toyosawa; U.S. Pat. No. 4,736,839 to King; U.S. Pat. No. 4,753,538 to Jorda; and U.S. Pat. No. Des. 312,899 to Faulkner.

While these devices fulfill their respective, particular objectives and requirements, the aforementioned patents do not disclose a new broomstick skirt drying tube. The inventive device includes a tube constructed of a flexible open weave material. The tube has an open upper end and an open lower end. The open lower end has a greater diameter than the open upper end. The open upper end has a cylindrical collar extending downwardly thereof. The tube is dimensioned for receiving a wet skirt therein.

In these respects, the broomstick skirt drying tube according to the present invention substantially departs from the conventional concepts and designs of the prior art, and in so doing provides an apparatus primarily developed for the purpose of creating sharp creases in broomstick skirts.

SUMMARY OF THE INVENTION

In view of the foregoing disadvantages inherent in the known types of garment bags now present in the prior art, the present invention provides a new broomstick skirt drying tube construction wherein the same can be utilized for creating sharp creases in broomstick skirts.

The general purpose of the present invention, which will be described subsequently in greater detail, is to provide a new broomstick skirt drying tube apparatus and method which has many of the advantages of the garment bags mentioned heretofore and many novel features that result in a new broomstick skirt drying tube which is not anticipated, rendered obvious, suggested, or even implied by any of the prior art garment bags, either alone or in any combination thereof.

To attain this, the present invention generally comprises a tube constructed of a flexible open weave material. The tube has an open upper end and an open lower end. The open lower end has a greater diameter than the open upper end. The open upper end has a cylindrical collar extending downwardly thereof. The tube is dimensioned for receiving a wet skirt therein,. A pair of elastic bands are secured around the open upper end and the open lower end of the tube. A handle portion is secured to the cylindrical collar of the tube. The handle portion has an inverted U-shaped configuration for hanging the tube at an elevation for drying the skirt disposed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new broomstick skirt drying tube apparatus and method which has many of the advantages of the garment bags mentioned heretofore and many novel features that result in a new broomstick skirt drying tube which is not anticipated, rendered obvious, suggested, or even implied by any of the prior art garment bags, either alone or in any combination thereof.

It is another object of the present invention to provide a new broomstick skirt drying tube which may be easily and efficiently manufactured and marketed.

It is a further object of the present invention to provide a new broomstick skirt drying tube which is of a durable and reliable construction.

An even further object of the present invention is to provide a new broomstick skirt drying tube which is susceptible of a low cost of manufacture with regard to both materials and labor, and which accordingly is then susceptible of low prices of sale to the consuming public, thereby making such broomstick skirt drying tube economically available to the buying public.

Still yet another object of the present invention is to provide a new broomstick skirt drying tube which provides in the apparatuses and methods of the prior art some of the advantages thereof, while simultaneously overcoming some of the disadvantages normally associated therewith.

Still another object of the present invention is to provide a new broomstick skirt drying tube for creating sharp creases in broomstick skirts.

Yet another object of the present invention is to provide a new broomstick skirt drying tube which includes a tube constructed of a flexible open weave material. The tube has an open upper end and an open lower end. The open lower end has a greater diameter than the open upper end. The open upper end has a cylindrical collar extending downwardly thereof. The tube is dimensioned for receiving a wet skirt therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
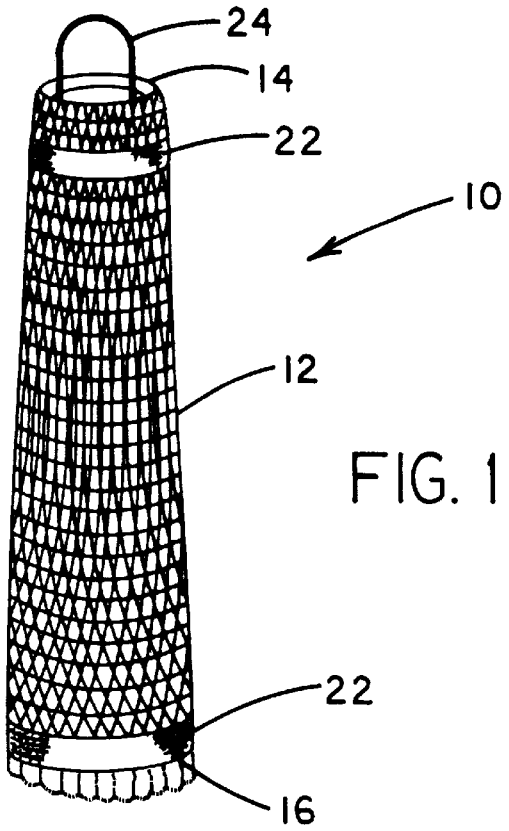
FIG. 1 is a front isometric view of a new broomstick skirt drying tube according to the present invention.
Figure 2:
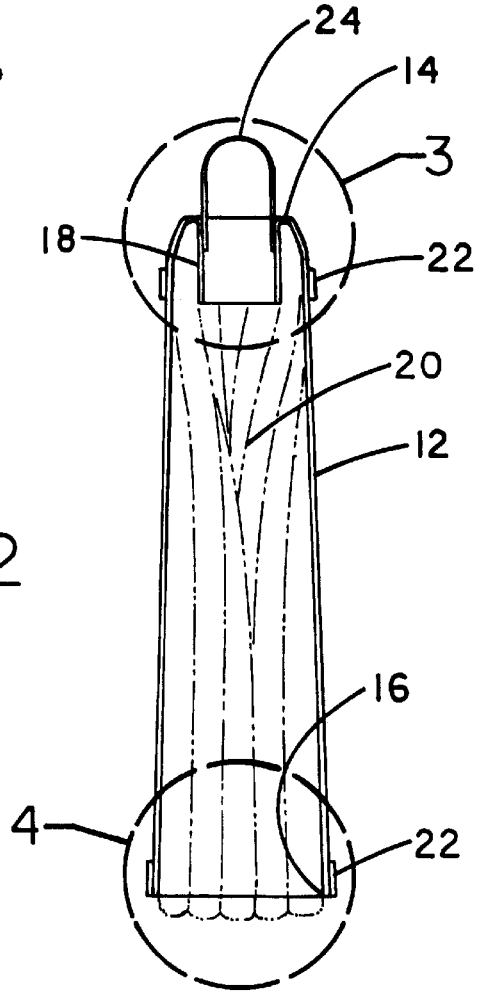
FIG. 2 is a cross-sectional front view of the present invention.
Figure 3:
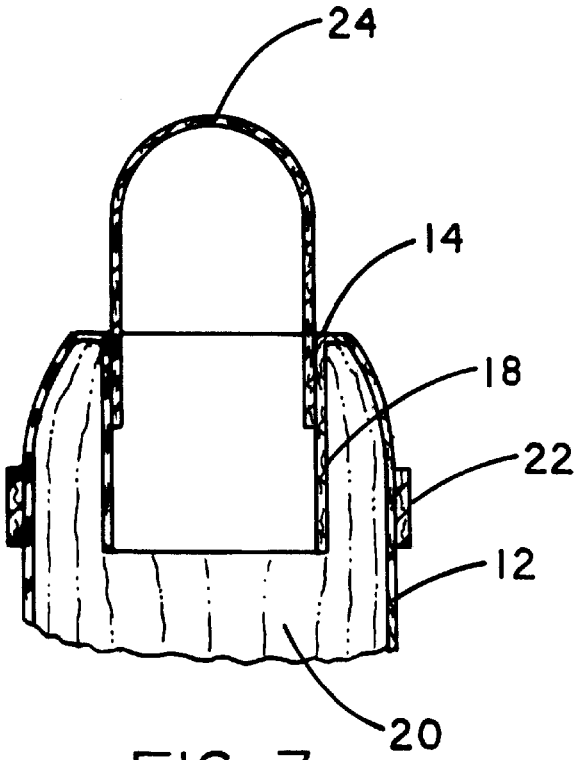
FIG. 3 is a front view of the handle of the present invention as taken from circle 3 of FIG. 2.
Figure 4:
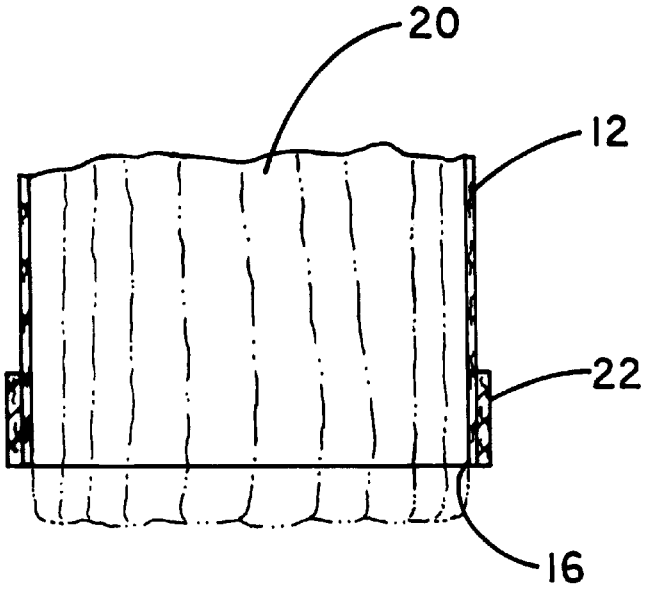
FIG. 4 is a front view of a lower portion of the present invention as taken from circle 4 of FIG. 2.

With reference now to the drawings, and in particular to FIGS. 1 through 4 thereof, a new broomstick skirt drying tube embodying the principles and concepts of the present invention and generally designated by the reference numeral 10 will be described.

As best illustrated in FIGS. 1 through 4, the broomstick skirt drying tube 10 comprises a tube 12 constructed of a flexible open weave material. The tube 12 has an open upper end 14 and an open lower end 16. The open lower end 16 has a greater diameter than the open upper end 14. The open upper end 14 has a cylindrical collar 18 extending downwardly therefrom. The tube 12 is dimensioned for receiving a wet skirt 20 therein.

A pair of elastic bands 22 are secured around the open upper end 14 and the open lower end 16 of the tube 12. The elastic bands 22 apply pressure and close the tube 12 over the wet skirt 22 in order to allow the skirt 22 to properly dry.

A handle portion 24 is secured to the cylindrical collar 18 of the tube 12. The handle portion 24 has an inverted U-shaped configuration for hanging the tube 12 at an elevation for drying the skirt 22 disposed therein.

In use, the user would simply insert a skirt 20 within the open lower end 16 of the tube 12 and then pulled through to the open upper end 14 of the tube 12. The user would then adjust the elastic bands 22 over the tube 12 to close the tube 12 around the skirt 22 so that it can hang to dry to create a professional-looking crease in the skirt 22. The handle 24 allows the tube 12 to hang from a clothesline or door handle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to, the exact construction and operation shown and described, and accordingly, all suitable modifications and equivalents may be resorted to, falling within the scope of the invention.

I claim:

1. A broomstick skirt drying system for creating sharp creases in broomstick skirts comprising, in combination:

a skirt having an upper perimeter and a lower perimeter; and a skirt drying tube comprising a tube constructed of a flexible open weave material defining an interior, the tube having an open upper end and an open lower end, the open lower end having a greater diameter than the open upper end;

a cylindrical collar extending downwardly from the open upper end into the interior of the tube for forming a space at the upper end of the tube to permit air to enter the tube through the open upper end of the tube, the skirt being received in the tube;

a pair of elastic bands, one of the elastic bands being secured around the tube adjacent to the open upper end of the tube and the other of the elastic bands being secured around the tube adjacent to the open lower end of the tube, the one of the elastic bands pressing the upper perimeter of the skirt against the cylindrical collar to thereby hold the skirt in the tube, the other of the elastic bands compressing the lower perimeter of the skirt during drying of the skirt; and a handle portion secured to the cylindrical collar of the tube, the handle portion having an inverted U-shaped configuration for hanging the tube at an elevation for drying the skirt disposed therein.

2. A skirt drying tube for creating sharp creases in broomstick skirts of the type having an upper perimeter and a lower perimeter, the skirt drying tube comprising:

a tube constructed of a flexible open weave material defining an interior, the tube having an open upper end and an open lower end, the open lower end having a greater diameter than the open upper end, the open upper end having a cylindrical collar extending downwardly therefrom, the tube being dimensioned for receiving a wet skirt therein;

a cylindrical collar extending downwardly from the open upper end into the interior of the tube and being unsecured to the tube below the open upper end for forming a space at the upper end of the tube to permit air to enter the tube through the open upper end of the tube;

a pair of elastic bands, one of the elastic bands being secured around the tube adjacent to the open upper end of the tube and the other of the elastic bands being secured around the tube adjacent to the open lower end of the tube, the one of the elastic bands being adapted for pressing an upper perimeter of the skirt against the cylindrical collar to thereby hold the skirt in the tube, the other of the elastic bands being adapted for compressing a lower perimeter of the skirt during drying of the skirt; and a handle portion secured to the cylindrical collar of the tube for hanging the tube for drying a skirt disposed therein.

3. The skirt drying tube as set forth in claim 2 wherein the cylindrical collar has a length, and wherein the length of the cylindrical collar is about one eighth of the distance between the open upper end and the open lower end of the tube.

4. The skirt drying tube as set forth in claim 2 wherein the handle portion has an inverted U-shaped configuration for hanging the tube for drying the skirt disposed therein.

* * * * *